US005727280A

United States Patent [19]

Romano

[11] Patent Number: 5,727,280

[45] Date of Patent: Mar. 17, 1998

[54] BRUSH HOLDER WITH INTEGRAL DRYING STRUCTURE

[76] Inventor: Richard Romano, 223 Southaven Ave., Medford, N.Y. 11763

[21] Appl. No.: 718,274

[22] Filed: Sep. 20, 1996

[51] Int. Cl.[6] ..... A46B 17/00

[52] U.S. Cl. ..... 15/248.1; 15/263; 401/121; D6/551

[58] Field of Search ..... 15/248.1, 257.01, 15/257.1, 260, 263; 206/208, 209, 209.1, 244, 361; 312/206, 207; 401/15, 121, 122; D6/551

[56] References Cited

U.S. PATENT DOCUMENTS

| | | | |
|---|---|---|---|
| 891,262 | 6/1908 | Jenkins | 401/121 |
| 1,138,523 | 5/1915 | Withycombe | 206/209.1 |
| 2,782,909 | 2/1957 | McNamara | 15/248.1 |
| 3,263,803 | 8/1966 | Almond | 206/209 |
| 3,406,422 | 10/1968 | Nichols | 15/263 |
| 4,211,750 | 7/1980 | Gillespie | 206/361 |

FOREIGN PATENT DOCUMENTS

| | | | |
|---|---|---|---|
| 1477991 | 3/1967 | France | 206/361 |
| 1503753 | 5/1969 | Germany | 15/263 |
| 275746 | 9/1951 | Switzerland | 15/257.01 |

*Primary Examiner*—Terrence Till
*Attorney, Agent, or Firm*—Galgano & Burke

[57] ABSTRACT

A brush holder includes a generally cylindrical container with an inner annular flange close to its open end and a raised brush support which defines a lower liquid reservoir. The annular flange is preferably inclined toward the bottom of the container or, alternatively, is perforated. The dimensions of the annular flange are chosen such that when a brush is inserted into the container and removed from the container, the flange squeezes the brush. As the brush is squeezed, liquid is removed from the brush and drips into the liquid reservoir. The brush support is preferably a raised central portion of the container floor which defines an annular reservoir or, alternatively, the brush support may be formed as a perforated disk which is spaced above the floor of the container. The brush support keeps the brush out of the reservoir so that the brush will remain dry. According to the presently preferred embodiment, the outer surface of the cylindrical container is provided with a step so that the container will fit into and be supported by a maid's caddy.

17 Claims, 3 Drawing Sheets

BRUSH HOLDER WITH INTEGRAL DRYING STRUCTURE

BACKGROUND OF THE INVENTION

1. Field of the Invention

The invention relates to a brush holder which is particularly suited for use with a toilet bowl brush. More particularly, the invention relates to a brush holder having an upper annular structure and a lower elevated structure which cooperate to dry a brush inserted into the holder.

2. State of the Art

Toilet bowl brushes are used in the home and by commercial cleaning services in conjunction with cleanser to clean toilet bowls. The brushes typically have a relatively long handle and are usually provided with a spongy absorbent material at one end of the handle.

Brush holders of various types are known in the art for use with toilet bowl brushes. The known holders are mainly concerned with appearance and are designed for use in the home to conceal an otherwise unsightly toilet bowl brush.

In the home, toilet bowl brushes are used relatively infrequently (usually no more than once a day) such that between uses the brush will dry due to natural evaporation. In commercial use, however, toilet bowl brushes are used very frequently and it is difficult or impossible to dry the brush between uses. Typically, a commercial cleaning operation will involve daily cleaning of dozens of toilets, possibly hundreds of toilets. Cleaning personnel use a tray ("maid's caddy") which holds cleaning equipment including cleansers and brushes. Brushes are often carried in a cylindrical container which accumulates dirty water or cleaning solutions each time the brush is used. Thus, after the first use, the brush will remain wet and each subsequent use will require care to avoid dripping dirty water or cleaning solutions. Moreover, the effectiveness of a wet brush is substantially less than the effectiveness of a dry brush.

SUMMARY OF THE INVENTION

It is therefore an object of the invention to provide a brush holder which is well suited for use with a toilet bowl brush.

It is also an object of the invention to provide a brush holder having internal structure which helps to dry the brush quickly.

It is another object of the invention to provide a brush holder having an inner flange which helps squeeze the brush of excess liquids.

It is another object of the invention to provide a brush holder which fits conveniently into a maid's caddy.

It is still another object of the invention to provide a brush holder which is easy and inexpensive to manufacture.

In accord with these objects which will be discussed in detail below, the brush holder of the present invention includes a generally cylindrical container with an inner annular flange close to its open end and a raised brush support which defines a lower water reservoir. The annular flange is preferably inclined toward the bottom of the container or, alternatively, is perforated. The dimensions of the annular flange are chosen such that when a brush is inserted into the container and removed from the container, the flange squeezes the brush. As the brush is squeezed, water is removed from the brush and drips into the water reservoir. The brush support is preferably a raised central portion of the container floor which defines an annular water reservoir or, alternatively, the brush support may be formed as a perforated disk which is spaced above the floor of the container. The brush support keeps the brush out of the water reservoir so that the brush will remain dry. According to the presently preferred embodiment, the outer surface of the cylindrical container is provided with a step so that the container will fit into and be supported by a maid's caddy.

Preferred aspects of the invention include: forming the raised brush support as a central hub in the floor of the container with a slightly concave upper end to support a brush; molding the container in two parts (upper and lower) which are snap fit together and/or sonically welded or glued.

While the brush holder according to the invention is particularly well suited for use with a toilet bowl brush, it may be advantageously used with any similar type of brush which is preferably kept dry. Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
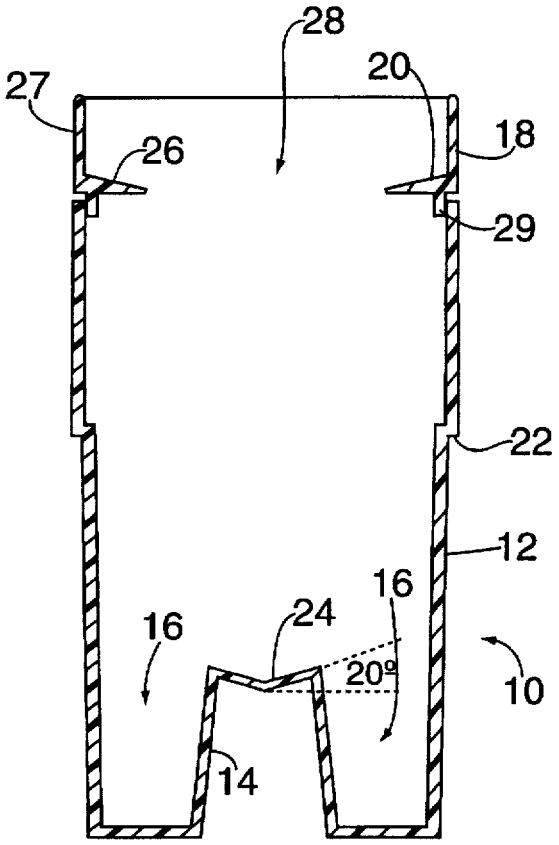
FIG. 1 is a side sectional view of a first embodiment of the invention.
Figure 3:
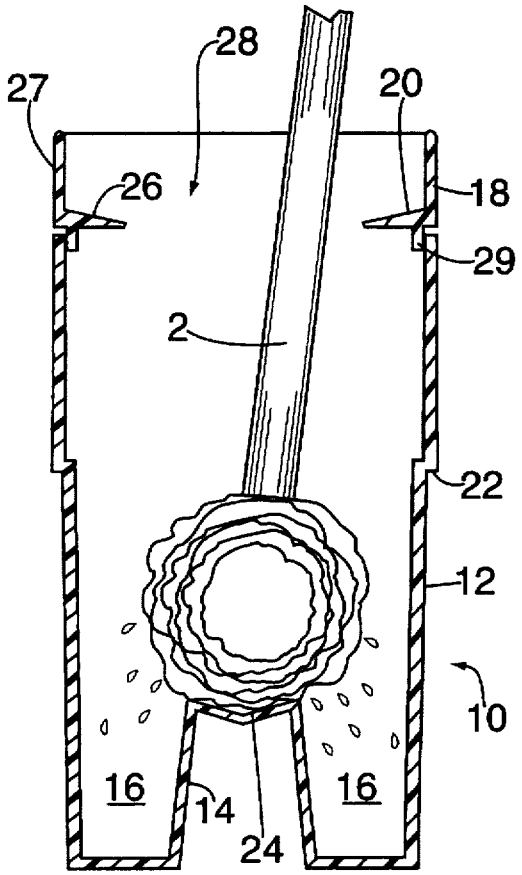
FIG. 3 is a view similar to FIG. 1 with a brush.
Figure 2:
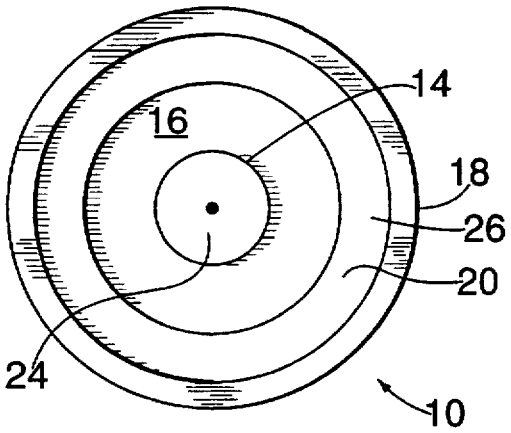
FIG. 2 is a top view of the embodiment of FIG. 1.

Referring now to FIGS. 1 through 3, a presently preferred embodiment of a brush holder 10 according to the invention includes a lower cylindrical portion 12 having a central raised floor portion 14 which defines an annular water reservoir 16, and an upper cylindrical portion 18 having an annular flange 20 surrounded by an upstanding outer wall 27. According to the presently preferred embodiment, the lower cylindrical portion 12 is provided with a step 22, the raised floor portion 14 has a concave upper surface 24, and the annular flange 20 has a downwardly inclined upper surface 26. The brush holder 10 is preferably molded from light weight plastic such as polypropylene.

The presently preferred brush holder 10 has an overall height of approximately 7.25 inches and a wall thickness of approximately 0.187 inches. The step 22 is preferably located slightly above mid-height and the outer diameter of the holder 10, above the step 22 is approximately 4.0 inches. Below the step 22, the diameter is approximately 3.5 inches which corresponds to the diameter of a hole in a conventional maid's caddy. As shown in FIGS. 1 and 3, the lower cylindrical portion 12 below the step 22 is slightly tapered to allow easy insertion into a maid's caddy. The diameter of the raised floor portion is preferably approximately 1.25 inches and the diameter of the entry 28 defined by the annular flange 20 is preferably approximately 2.5 inches. The upstanding wall 27 is preferably approximately one inch tall. The concave upper surface 24 of the raised portion 14 is preferably formed as a conic surface having an angle of approximately 20°. Given these dimensions, the water reservoir 16 has a capacity of approximately six ounces.

As described, the presently preferred embodiment is constructed from two molded pieces 12 and 18 which are snap-fit or otherwise connected to each other. As shown in FIGS. 1 and 3, the upper portion 18 is provided with a lower cylindrical part 29 which is dimensioned to fit into the upper end of the lower portion 12.

Referring now to FIG. 3, it will be appreciated that the diameter of the entry 28 is somewhat smaller than the outer diameter of the absorbent sponge 4 of a conventional toilet brush 2. Thus, when the brush 2 is inserted into the holder 10 as shown in FIG. 3, the annular flange 20 will squeeze the sponge 4 and cause water to be removed from the sponge 4. The inclined upper surface 26 and the upstanding wall 27 capture the water and direct it into the entry 28 whereupon the water drips into the reservoir 16. The raised floor portion 14 supports the sponge 4 of the brush 2 above the water in the reservoir 16. When the brush 2 is removed from the holder 10, the flange 20 will squeeze the sponge 4 again and remove any remaining water from the sponge. When the reservoir 16 becomes full, the holder 10 is easily inverted to empty the reservoir.

Figure 4:
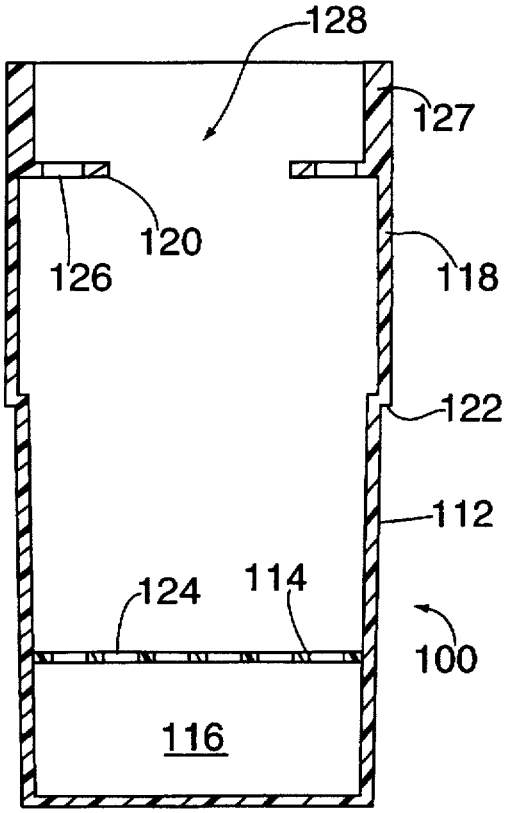
FIG. 4 is a side sectional view of a second embodiment of the invention.
Figure 6:
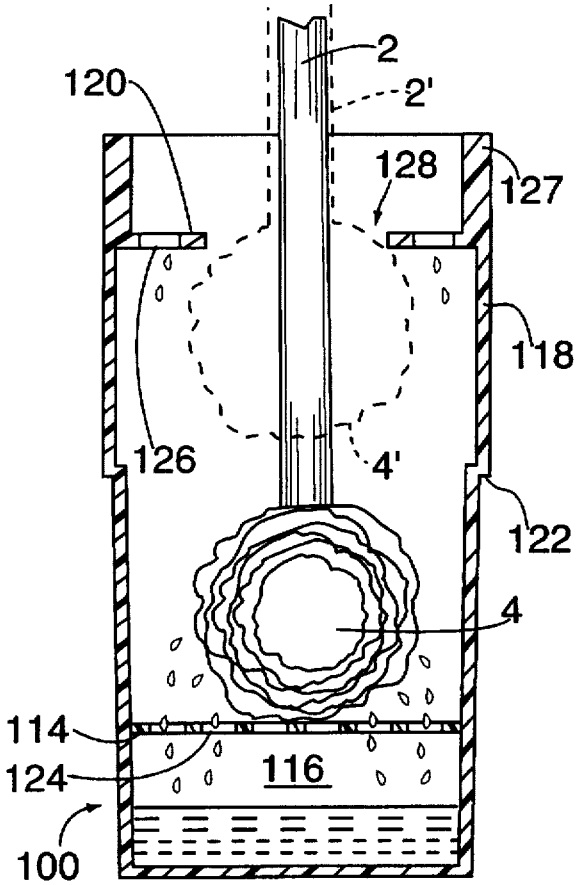
FIG. 6 is a view similar to FIG. 4 with a brush
Figure 5:
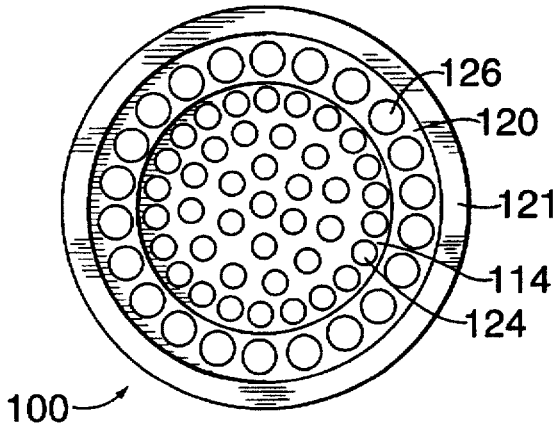
FIG. 5 is a top view of the embodiment of FIG. 4.

Referring now to FIGS. 4–6, a second embodiment of a brush holder 100 according to the invention is shown. The brush holder 100 is similar to the brush holder 10 and similar reference numerals are used in FIGS. 4–6 to refer to similar features. Generally, the holder 100 is a single cylinder having a lower portion 112 and an upper portion 118 separated by a step 122. The lower portion 112 holds a perforated disk 114 having a plurality of holes 124 and defining a lower water reservoir 116. The upper portion 118 holds an annular flange 120 which is perforated with a plurality of holes 126, is surrounded by an upstanding outer wall 127, and defines an entry 128 to the holder 100.

The second embodiment of the holder 100 functions is substantially the same manner as the first embodiment. As shown in FIG. 6, the entry 128 defined by the flange 120 has a diameter which is smaller than the outer diameter of the sponge 4 (4' in phantom lines) of a toilet brush 2 (2' in phantom). As the brush is inserted into the holder, the sponge 4 (4') is squeezed and water drips into the reservoir 116 through the holes 126 and 124. The disk 114 supports the brush above the water. When the brush is removed, the flange 120 squeezes the sponge again to remove water remaining in the sponge.

Figure 7:
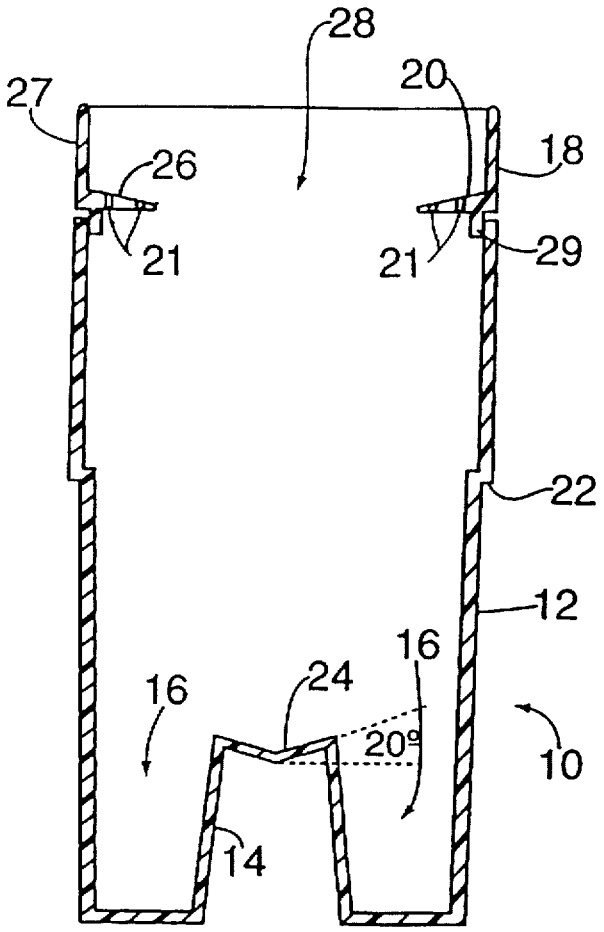
FIG. 7 is a side sectional view of another embodiment of the invention.

FIG. 7 shows another embodiment of the present invention wherein annular flange 20 is perforated forming a plurality of apertures 21 therein. Apertures 21 act to drain excess fluid which may tend to accumulate on flange 20.

There have been described and illustrated herein several embodiments of a toilet brush holder. While particular embodiments of the invention have been described, it is not intended that the invention be limited thereto, as it is intended that the invention be as broad in scope as the art will allow and that the specification be read likewise. Thus, while particular dimensions and materials have been disclosed, it will be appreciated that other dimensions and materials could be utilized. Also, while particular means for assembling parts have been shown, it will be recognized that other means of assembly could be used with similar results obtained. Moreover, while the holder has been described as substantially cylindrical, it will be appreciated that other configurations could be used as well. For example, in lieu of a cylinder, the holder could be formed with a polygonal surface which approximates a cylinder. Furthermore, while the holder has been disclosed as having a step for mounting the holder in a maid's caddy, it will be understood that a brush holder without a step can achieve the same or similar function as disclosed herein. In particular, the invention can be modified for us with other types of brushes wherein the step becomes unnecessary. Altering the dimensions of the holder can result in a brush holder which is useful for different kinds of brushes.

It will therefore be appreciated by those skilled in the art that yet other modifications could be made to the provided invention without deviating from its spirit and scope as so claimed.

I claim:

1. A brush holder comprising:

a substantially cylindrical container having a side wall, an upper open end and a lower closed end, an interior annular flange between the upper open end and the lower closed end, said lower closed end having a central raised floor portion and an annular lower liquid reservoir defined between said central raised floor portion, said side wall and said lower closed end of said container.

2. A brush holder according to claim 1, wherein:

the annular flange has an upper inclined surface.

3. A brush holder according to claim 1, wherein:

said raised floor portion has a concave upper surface.

4. A brush holder according to claim 3, wherein:

said concave upper surface is a conical surface having an angle of approximately 20°.

5. A brush holder according to claim 1, wherein:

said substantially cylindrical container is made from two substantially cylindrical molded pieces which fit together.

6. A brush holder according to claim 5, wherein:

said molded pieces are polypropylene.

7. A brush holder comprising:

a substantially cylindrical container having a side wall, an upper open end and a lower closed end, a perforated interior annular flange between the upper open end and the lower closed end, said lower closed end having a raised floor portion and a lower liquid reservoir defined between said raised floor portion, said side wall and said lower closed end of said container.

8. A brush holder according to claim 7, wherein:

the annular flange has an upper inclined surface.

9. A brush holder according to claim 7, wherein:

said substantially cylindrical container has a stepped outer surface.

10. A brush holder according to claim 7, wherein:

the raised floor portion is a perforated disk and the liquid reservoir is substantially cylindrical.

11. A brush holder according to claim 7, wherein:

said raised floor portion has a concave upper surface.

12. A brush holder according to claim 7, wherein:

said substantially cylindrical container is made from two substantially cylindrical molded pieces which fit together.

13. A brush holder comprising:

a substantially cylindrical container having a stepped outer surface, a side wall, an upper open end and a lower closed end, an interior annular flange between the upper open end and the lower closed end, said lower closed end having a raised floor portion and a lower liquid reservoir defined between said raised floor portion, said side wall and said lower closed end of said container.

14. A brush holder according to claim 13, wherein:

the annular flange has an upper inclined surface.

15. A brush holder according to claim 13, wherein:

said raised floor portion has a concave upper surface.

16. A brush holder according to claim 13, wherein:

said substantially cylindrical container is made from two substantially cylindrical molded pieces which fit together.

17. A brush holder according to claim 16, wherein:

said molded pieces are polypropylene.

* * * * *